US005249746A

United States Patent [19]

Kaneko et al.

[11] Patent Number: 5,249,746

[45] Date of Patent: Oct. 5, 1993

[54] LOW PRESSURE PAINT ATOMIZER-AIR SPRAY GUN

[75] Inventors: Masaru Kaneko; Nobuyoshi Morita; Hajime Iwata, all of Yokohama, Japan

[73] Assignee: Iwata Air Compressor Mfg. Co., Ltd., Tokyo, Japan

[21] Appl. No.: 698,772

[22] Filed: May 13, 1991

[30] Foreign Application Priority Data

May 11, 1990 [JP] Japan ..... 2-122126

[51] Int. Cl.[5] ..... B05B 1/28

[52] U.S. Cl. ..... 239/296; 239/299; 239/597; 239/601; 239/424; 239/526

[58] Field of Search ..... 239/290, 296, 418, 423, 239/424, 525, 526, 297, 299, 601, 599, 597

[56] References Cited

U.S. PATENT DOCUMENTS

| | | | |
|---|---|---|---|
| 2,070,696 | 2/1937 | Tracy | 239/296 |
| 2,743,963 | 5/1956 | Peeps | 239/296 |
| 3,232,540 | 2/1966 | Cassanmagnago | 239/418 |
| 4,219,157 | 8/1980 | Binoche | 239/296 |
| 4,236,674 | 12/1980 | Dixon | 239/299 |
| 4,273,287 | 6/1981 | Huber | 239/299 |
| 4,349,153 | 9/1982 | Johnson | 239/296 |
| 4,527,507 | 7/1985 | Sawai et al. | 239/299 |
| 4,657,184 | 4/1987 | Weinstein | 239/296 |
| 4,767,057 | 8/1988 | Degli et al. | 239/296 |
| 4,824,017 | 4/1989 | Mansfield | 239/299 |
| 4,854,504 | 8/1989 | Hedger, Jr. et al. | 239/296 |
| 4,915,303 | 4/1990 | Hufgard | 239/526 |
| 4,934,602 | 6/1990 | Mattson | 239/300 |
| 5,180,104 | 1/1993 | Mellette | 239/599 |

FOREIGN PATENT DOCUMENTS

| | | | |
|---|---|---|---|
| 727505 | 10/1942 | Fed. Rep. of Germany | 239/296 |
| 993854 | 10/1951 | France | 239/290 |
| 522351 | 6/1940 | United Kingdom | 239/296 |
| 2031759 | 4/1980 | United Kingdom | 239/299 |
| 2143159 | 2/1985 | United Kingdom | 239/299 |

*Primary Examiner*—Andres Kashnikow
*Assistant Examiner*—Christopher G. Trainor
*Attorney, Agent, or Firm*—Wenderoth, Lind & Ponack

[57] ABSTRACT

An air spray gun comprising a nozzle with a frustoconically profiled tip, a cylindrical through bore, a V-shaped groove running across said through bore to form an oblong opening for ejecting paint under a pressure of 1 to 6Ckgf/cm$^2$ and atomizing the ejected paint by compressed air having a pressure of 0.5 to 2 kgf/cm$^2$, wherein an air cap is arranged to form an annular air outlet between the outer periphery of the nozzle tip and a central air outlet of the air cap and the nozzle tip is located within a front central through bore of the air cap. The invention preferably has at least a pair of auxiliary air outlets arranged in juxtaposition across the axis of the oblong opening to make the air jet streams from the air outlets cross and crash against the paint stream and at least a pair of angular air outlets to make the air jet streams from the angular air outlets cross and crash against the paint stream downstream of the first crossing and perpendicular to the first air jet streams to that the paint will be atomized under relatively low air pressure to prevent paint dissipation and consequently enhance the efficiency of painting.

4 Claims, 3 Drawing Sheets

LOW PRESSURE PAINT ATOMIZER-AIR SPRAY GUN

FIELD OF THE INVENTION

This invention relates to an air spray gun suitable to be used for atomizing and spraying paint by compressed air and more particularly it relates to an air spray gun capable of spraying paint under low air pressure to prevent generation and dissipation of misty paint and enhance the efficiency of painting.

PRIOR ART

A known air spray gun for atomizing and spraying paint by compressed air typically comprises a round paint nozzle through which paint is ejected in a jet stream and a number of air nozzles annularly arranged around the paint nozzle through which compressed air is driven out in order to atomize the paint being ejected. The arrangement of the air nozzles may be modified to meet the specific requirements of painting at a given work site and maximize the effect of painting. The air pressure to be used for spraying paint by such an air spray gun is normally between 2.5 and 5 kgf/cm$^2$ so that the paint will be ejected through the paint nozzle under the pressure of 0.5 to 3 kgf/cm$^2$ unless a highly viscous paint is involved. The Japanese Industrial Standard (JIS) provides that the bore of the paint nozzle should be between 0.5 mm and 2.5 mm$\phi$ and most nozzles available in Japan have inner diameters within this range.

The acknowledged greatest drawback of air spray guns of this type is dissipation of paint particles and, in order to minimize the problem of dissipation, there has been proposed an airless spray gun designed to force out paint under high pressure so that the paint can be divided into fine particles in the atmosphere without using compressed air. Such an airless spray gun normally comprises a spray nozzle having an oblong opening to produce a sector-like jet stream of paint. While it can considerably overcome the problem of dissipated paint, it requires a pressure as high as 100 kgf/cm$^2$ to be applied to the paint and a specially designed high pressure pump to produce such a high pressure. Since the paint should be ejected at a high rate, this technique cannot suitably be used for low viscous paints and thin paint coatings. Moreover, such a spray gun cannot produce satisfactorily fine paint particles and the sector-shaped jet stream can have at the lateral edges tails which are detrimental to the effect of spraying.

There has been developed a compromise a technique combining some of the features of both the airless spray and the air spray and it is actually being utilized on a commercial basis. Wi&h this technique, a nozzle having an oblong opening as in the case of airless spray is used and the paint is ejected under a pressure approximately as low as a half of the pressure for air spraying, or somewhere between 40 and 50 kgf/cm$^2$. The jet stream of paint is then made to crash against a stream of compressed air to avoid dissipation of paint particles.

There has also been proposed a paint atomizing apparatus that comprises a nozzle having an oblong opening and arranged within an air cap also having an oblong opening so that the paint ejected from said nozzle in the form of a flat jet stream is surrounded by an evenly flowing air stream and then forced out of the air cap under an atomizing condition.

While all the above described known paint spray techniques are accompanied by specific advantages and disadvantages and therefore being used in areas where the advantages can be most effectively exploited, &they are not completely free from the problem of paint dissipation that needs to be solved from the view point of environment protection as well as of economizing the consumption of paint and solvent.

Particularly, an air spray gun which is handy and can provide a fine and delicate finish is most conspicuously accompanied by the problem of paint dissipation and therefore most seriously requires improvements in terms of this problem.

The most significant cause of paint dissipation of an air spray gun is the high air pressure used for applying paint. It is, therefore, the object of the present invention to provide a handy air spray gun that can satisfactorily atomize paint by using relatively low air pressure and hence does not require a special high pressure pump.

SUMMARY OF THE INVENTION

According to the invention, the above object is achieved by providing an air spray gun comprising a nozzle with a frusto-conically profiled tip, a cylindrical through bore, a pair of V-shaped grooves running along said through bore and an oblong opening for ejecting paint under a pressure of 1 to 6 kgf/cm$^2$ and atomizing said ejected paint by compressed air having a pressure of 0.5 to 2 kgf/cm$^2$, wherein an air cap is provided to form an annular air outlet between the outer periphery of the nozzle tip and a central air outlet of the air cap and said nozzle tip is located within a front central through bore of the air cap.

An air spray gun according to the invention preferably comprises at least a pair of auxiliary air outlets arranged in juxtaposition across the axis of the oblong opening to make the air jet streams from said air outlets cross and crash against the paint stream and at least a pair of angular air outlets to make the air jet streams from said angular air outlets to cross and crash against the paint stream downstream of the first crossing and perpendicular to the first air jet streams so that the paint will be atomized under relatively low air pressure to prevent paint dissipation and consequently enhance the efficiency of painting.

Now the present invention will be described in greater detail by referring to the accompanying drawings that illustrate preferred embodiments of the invention.

DETAILED DESCRIPTION OF THE INVENTION

Since the overall configuration of a spray gun according to the invention is not different from that of known spray guns except for the atomizer, it will not be described here any further.

Figure 1:
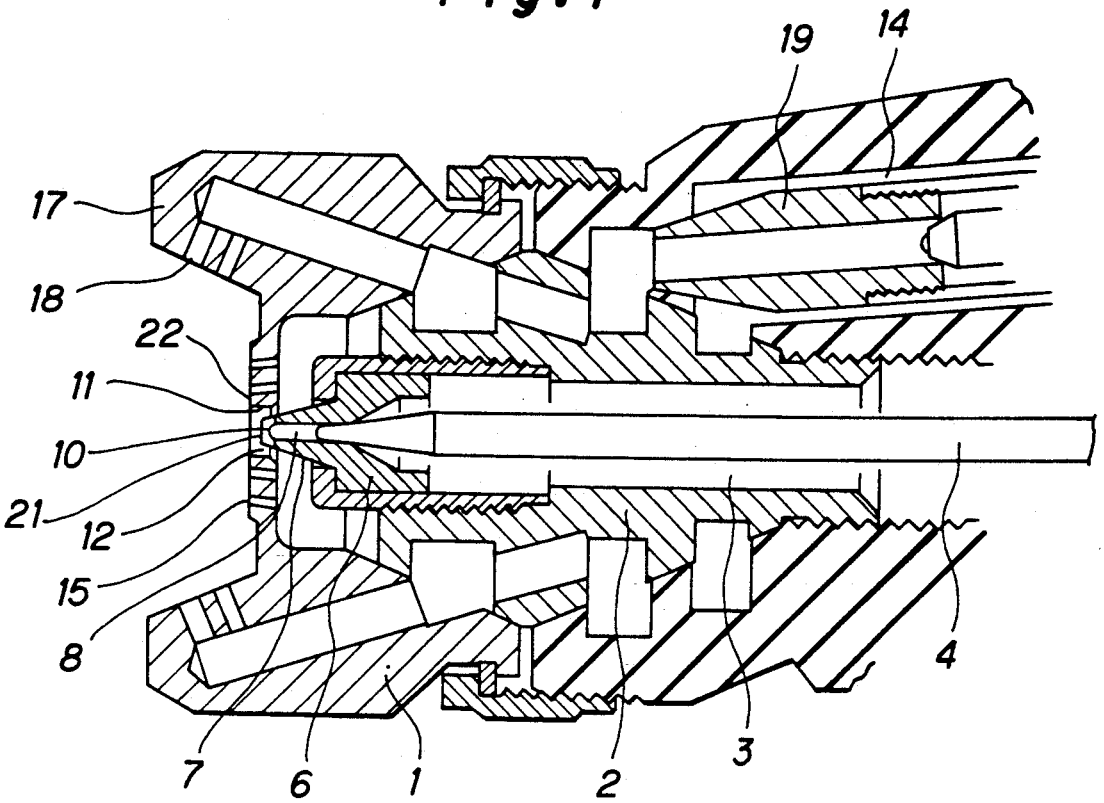
FIG. 1 is a sectional view of a first preferred embodiment of the spray gun of the invention, showing only the atomizer thereof.
Figure 2:
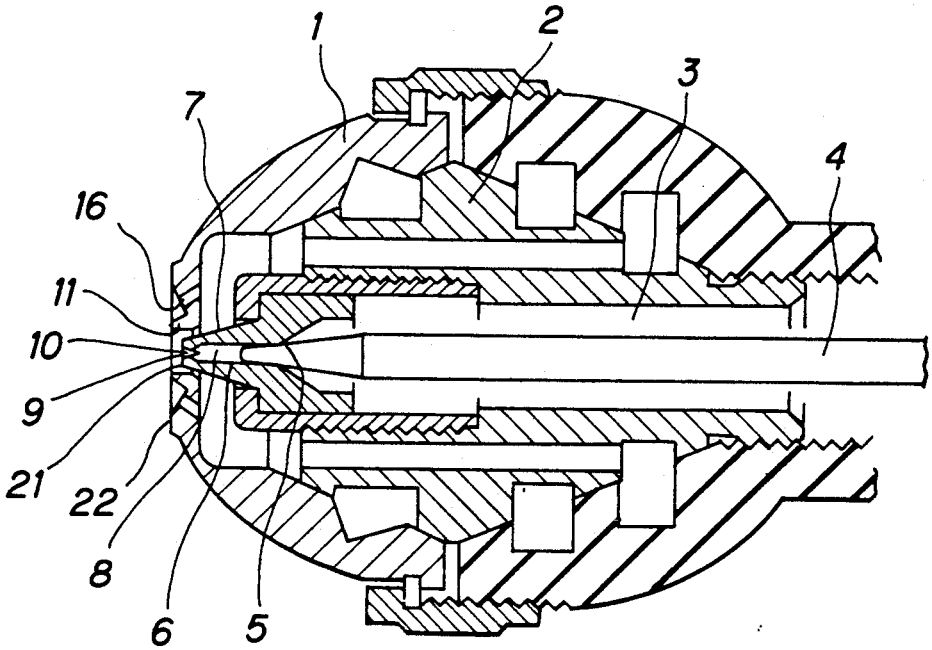
FIG. 2 is another sectional view of the atomizer of FIG. 1 cut along a plane perpendicular to the plane of FIG. 1.
Figure 3:
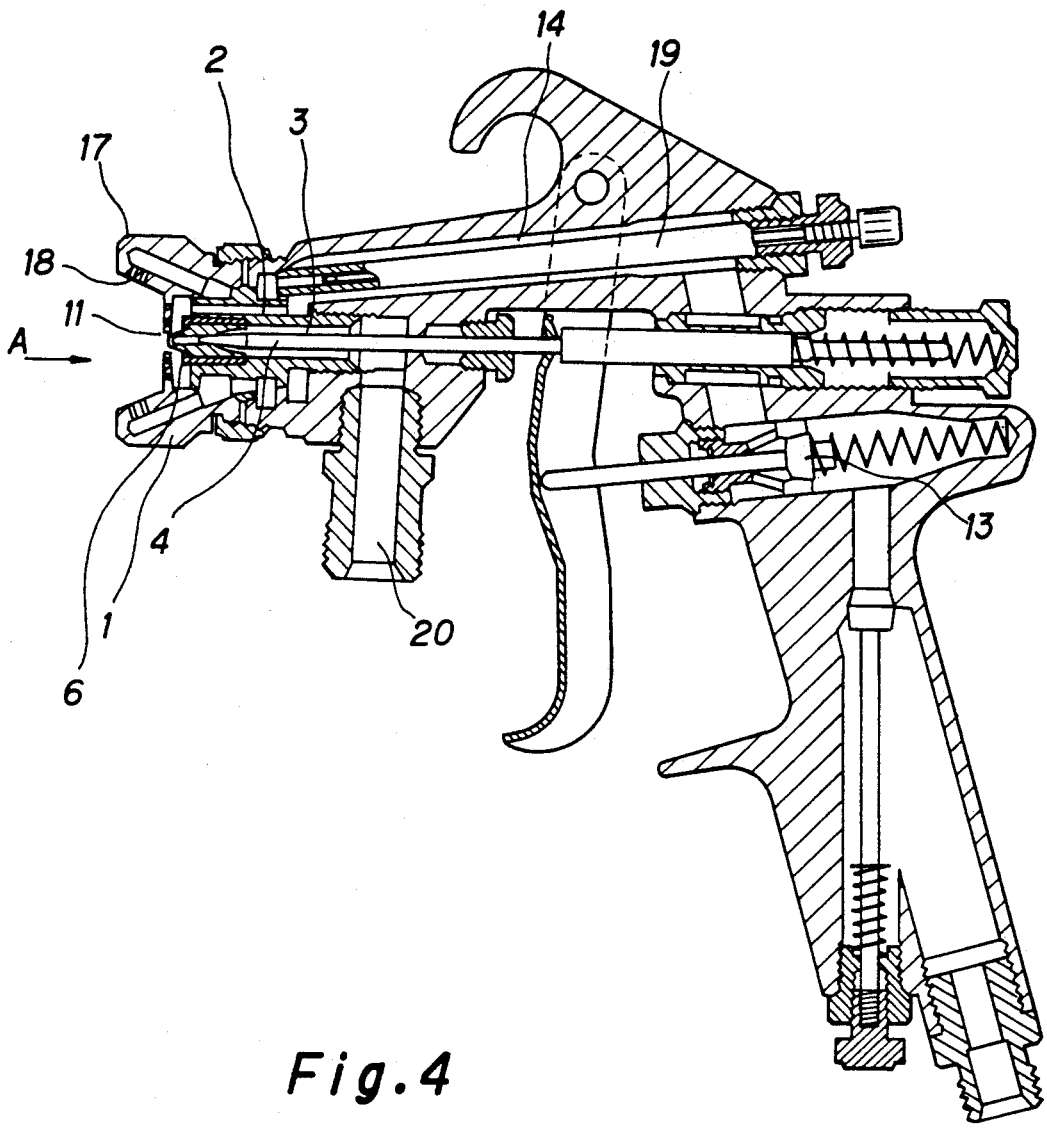
FIG. 3 is a sectional view of the embodiment of FIG. 1, showing the entire spray gun.
Figure 4:
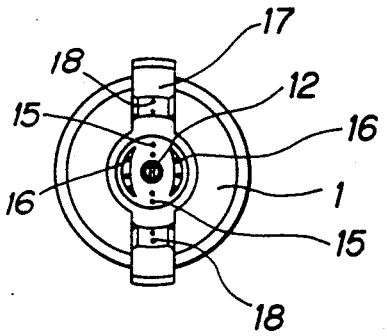
FIG. 4 is a front view of the air cap of the embodiment of FIG. 1.

The atomizer of the first embodiment of the invention comprises as principal components an air cap 1 and a paint nozzle 2, of which the latter or the paint nozzle 2 having a paint passage 3 running along the axis of the nozzle 2, in which a needle valve 4 and a valve seat 5 are arranged for ejection of paint and for stopping ejection of paint. As seen from FIGS. 1 and 2, the paint nozzle 2 comprises a nozzle tip 6 having a frusto-conical profile 7 and a through bore 8 having at the front end a V-shaped groove 9 running diametrically thereacross so that the nozzle 2 has a transversely oblong opening 10.

The air cap 1 is so designed that said nozzle tip 6 is located within the central bore 11 of the air cap 1 and the gap between the peripheral wall of the central bore 11 of the air cap 1 and the nozzle tip 6 defines a substantially annular air outlet 12. The front end 21 of the nozzle tip 6 is located inside the air cap 6 relative to the front end 22 of the latter so that the front end 22 of the air cap 6 has a shallow recess. While the depth of the recess depends on the profile of the nozzle tip 6, it is always within a given range where a substantially annular air outlet is appropriately defined by the front end 21 of the nozzle tip 6 and the peripheral wall of the central bore 11 of the air cap 2. In other words, the front end 21 should always be within the thickness of the front end of the air cap 6. Although the central bore 11 is preferably cylindrical, it may be slightly tapered. The inside of the air cap 1 is in communication with the inside of the spray gun via an air valve 13 and an air passage 14 of the spray gun and a pair of first auxiliary air outlets 15 and another pair of second auxiliary air outlets 16 are arranged outside the central bore 11, the air outlets 15 being symmetrically arranged and aligned with the axis of the oblong opening 10 while the air outlets 16 are symmetrically located at lateral sides of the opening 10. Each of the pairs of air outlets 15 and 16 may be multiplied air outlets and symmetrically arranged.

Each of the auxiliary air outlets 16 on the lateral sides of the opening 16 ejects air to widely diverge relative to the axis, whereas each of the auxiliary air outlets 15 aligned with the axis of the opening 10 is designed to eject an air jet stream with a relatively small angle of divergence. A pair of projections are radially and symmetrically positioned outside the auxiliary air outlets 15, each being provided with a peripheral air outlet 18 to eject an air stream at a relatively large angle to the axis of the paint jet stream. While there are a pair of air outlets 18 shown in this embodiment, two or more than two pairs of air outlets 18 may be alternatively provided. These air outlets 18 are in communication with said air path 14 via an pattern adjuster valve 19 so that the air flow rate through the air outlets 18 and hence the pattern of the paint jet stream may be controlled by the extent of opening of the pattern adjuster valve 19.

As a paint jet stream is ejected through the oblong opening 10 of the nozzle tip 6 into the annular air outlet 12, initially having an oblong cross section similar to that of the opening 10, the paint found at and near the remote ends of the major axis of the oblong cross section of the jet stream is atomized by the air running through the annular air outlet 12 and deflected toward the center of the paint jet stream so that the remaining paint is subsequently atomized. Then, the process of atomization is furthered particularly along the minor axis of the oblong cross section of the paint jet stream by the air coming out of the second auxiliary air outlets 16, which also decelerates the speed of the paint jet stream. Any tendency of the paint air jet stream trying to diverge along the major axis of its cross section is suppressed by the air flowing out of the first auxiliary air outlets 15 arranged in alignment with the axis of the oblong opening 10 so that relatively coarse paint particles will be brought back to the center of the paint jet stream.

The diverging tendency of the paint jet stream is further suppressed by the air ejected from the peripheral air outlets 18 and the paint jet stream is caused to form a desired pattern of painting.

Figure 5:
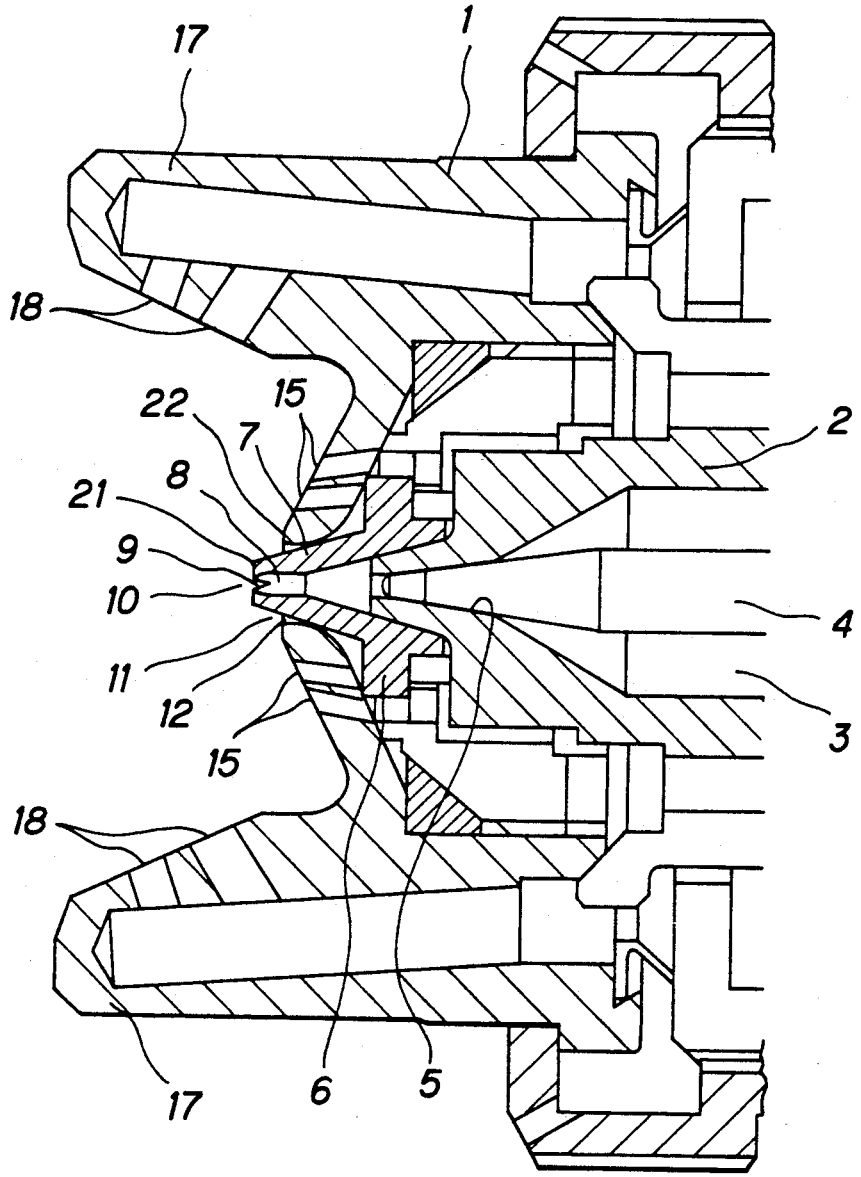
FIG. 5 is a sectional view of a second embodiment of the spray gun of the invention, showing only the atomizer thereof.

FIG. 5 of the accompanying drawings illustrates a second preferred embodiment of the invention. The components of this embodiment which are similar to those of the first embodiment are indicated by the same reference numerals.

Nozzle tip 6 arranged at the front end of paint nozzle 2 has a frusto-conical profile 7 and comprises a through bore 8 having at the front end by a V-shaped groove 9 running diametrically thereacross so that the nozzle 2 has a transversely oblong opening 10. Air cap 1 is so designed that said nozzle tip 6 is located within a central bore 11 of air cap 1 of the embodiment and the gap between the peripheral wall of the central bore 11 of the air cap 1 and the nozzle tip 6 defines a substantially annular air outlet 12.

Although the above described configuration of the second embodiment is identical with that of the first embodiment, the former differs from the latter in that the front end of the nozzle tip 6 is slightly projecting from the front end 22 of the central through bore 11.

With such an arrangement, the paint of the paint jet stream ejected from the oblong opening 10 of the nozzle tip 6 and having, therefore, an oblong cross section is atomized by the compressed air ejected out of the annular air outlet 12 of the air cap 1 and the process of atomization is furthered by the compressed air coming out of the second auxiliary air outlets 16 particularly along the minor axis of the oblong cross section of the paint jet stream. The compressed air reduces the velocity with which the air jet stream is ejected. Any tendency of the paint air jet stream trying to diverge along the major axis of its cross section is suppressed by the air plowing out of the first auxiliary air outlets 15 arranged in alignment with the axis of the oblong opening 10 so that relatively coarse paint particles will be brought back to the center of the paint jet stream.

The diverging tendency of the paint jet stream is further suppressed by the air ejected from peripheral air outlets 18 arranged outside the auxiliary air outlets 15 and the paint jet stream is caused to form a desired pattern of painting.

With each of the above described embodiments, when the front end of the nozzle has a diameter of 2 mm and the central through bore 11 of the air cap has a diameter of 3 to 4 mm, paint can be well atomized when the paint is ejected at a rate of 100 to 300 cc/min under a pressure of 1.56 $kgf/cm^2$ and air is forced out with a pressure of 0.3 to 0.5 $kgf/cm^2$ at the center, which respectively represent approximately one fifth of the air pressure and less than one twentieth of the paint pressure of known air spray guns. A low pressure pump or a low pressure tank for an ordinary air spray apparatus can be used for the purpose of the present invention since a paint pressure lower than 6 kgf/cm$^2$ is involved. It will be understood by those who are skilled in the art that an air pressure of less than 2 kgf/cm$^2$ also provides a major advantage for the present invention, representing less than a half of the air pressure involved in known air spray apparatus.

With a low pressure paint atomizer-air spray gun according to the invention, the paint is ejected from the paint nozzle under a pressure which is low but sufficient to form a paint jet stream having a flat cross section as it comes out of an oblong opening. At this stage, the air jet stream coming out of a substantially annular air outlet defined by the frusto-conical profile of the nozzle and the central through bore of the air cap collides the surface of the flat jet stream of paint to atomize the paint. Since the front end of the annular air outlet is located close to the paint outlet, the paint and the air collide when their velocities are maximal so that the atomization of paint is carried out effectively. The flat paint jet stream produces a surface area by far larger than that of a comparable round jet stream of a conventional air spray gun and therefore the collision of air and paint takes place very effectively. Moreover, since the lateral sides of the paint jet stream at the ends of the major axis of the cross section where atomization tends to be deterred are subjected to the shearing resistance of an air jet stream the entire process of atomization is conducted very effectively.

In short, the paint is atomized in the initial stages within the central through bore and then, immediately thereafter the paint is ejected in a flat jet stream, further atomized by the air jet stream hitting the surface of the flat paint strea particularly in the area along the minor axis of its cross section. Then, at a downstream point, a pair of air streams ejected from the air outlets oppositely arranged along the major axis of the cross section of the flat paint stream thoroughly atomize the portion of the paint that has not been atomized and apply the paint in a desired paint pattern.

As is apparent from the above description, a low pressure paint atomizer-air spray gun according to the invention can sufficiently and satisfactorily atomize paint with relatively low air pressure without undesirably reducing the pressure and the velocity with which paint is ejected in a jet stream so that paint can be effectively applied in a desired paint pattern without loss through dissipation and consequently the efficiency of painting can be remarkably enhanced.

What is claimed is:

1. A low pressure atomizer-air spray gun comprising:

a nozzle having a frusto-conically profiled tip and a cylindrical through bore therethrough and a V-shaped groove extending across said tip at the end of said through bore to form an oblong opening for ejecting paint in a flattened oblong crosssectional pattern corresponding to the shape of said opening and having a diverging tendency toward the ends of the major axis of the oblong opening; and an air cap around said nozzle and having a front central through bore therein within which said nozzle tip is positioned and defining with the outer peripheral surface of said nozzle a substantially circular annular air outlet for ejecting air under pressure in a substantially circular annular pattern around the ejected paint for intersecting and atomizing paint at and near the ends of the oblong crosssectional pattern of the ejected paint;

whereby when paint is ejected through said oblong opening under a pressure of from 1 to 6 kgf/cm$^2$ said ejected paint can be well atomized by compressed air ejected through said air cap at a pressure of from 0.5 to 2 kgf/cm$^2$.

2. A spray gun as claimed in claim 1 in which the end of the tip is slightly recessed in said air cap through bore from a front wall of said air cap.

3. A spray gun as claimed as claimed in claim 1 in which the end of the tip projects through said air cap through bore slightly past a front wall of said air cap.

4. A spray gun as claimed in claim 1 further comprising at least one pair of auxiliary air outlets in a front wall of said air cap symmetrically positioned on opposite sides of said air cap through bore and adjacent the narrow ends of said oblong opening and directed in a direction to intersect on the path of paint discharged through said oblong opening, and at least one further pair of air outlets in said air cap with the outlets symmetrically positioned on opposite sides of said oblong opening and lying along a line perpendicular to a line connecting said auxiliary air outlets and directed in a direction to intersect on the path of paint discharged through said oblong opening at a point downstream in the direction of paint being discharged from the point of intersection of the directions of said auxiliary air outlets.

* * * * *